United States Patent [19]

Norton

[11] Patent Number: 5,058,492

[45] Date of Patent: Oct. 22, 1991

[54] INSULATED DIFFUSER FOR EVAPORATIVE AIR COOLING SYSTEM

[76] Inventor: Doug Norton, 9224 Jana Lee Dr., West Jordan, Utah 84088

[21] Appl. No.: 488,735

[22] Filed: Mar. 2, 1990

[51] Int. Cl.[5] ..... F24F 13/20

[52] U.S. Cl. ..... 98/119; 98/40.13

[58] Field of Search ..... 98/40.05, 40.12, 40.13, 98/116, 119

[56] References Cited

U.S. PATENT DOCUMENTS

| | | | |
|---|---|---|---|
| 4,047,475 | 9/1977 | Cox | 98/119 X |
| 4,377,059 | 3/1983 | Kuhr | 98/40.12 X |
| 4,735,132 | 4/1988 | Ching | 98/119 |
| 4,760,773 | 8/1988 | Pezzulli | 98/119 X |

FOREIGN PATENT DOCUMENTS

| | | | |
|---|---|---|---|
| 3438724 | 4/1986 | Fed. Rep. of Germany | 98/40.12 |

*Primary Examiner*—Harold Joyce

*Attorney, Agent, or Firm*—Dennis L. Mangrum

[57] ABSTRACT

A device which permits rapid conversion of an air diffuser in an evaporative air conditioning system during periods of use, to an insulative dampening member during periods of non-use. The device attaches to the opening of outlet air duct of the cooling system and is adapted to receive and secure alternately an air diffuser during periods of cooling, and an insulative dampening block during periods of non-use.

5 Claims, 2 Drawing Sheets

INSULATED DIFFUSER FOR EVAPORATIVE AIR COOLING SYSTEM

BACKGROUND OF THE INVENTION

1. Field of the Invention

The present invention is for use in an evaporative air cooling system for residential or commercial use and specifically permits dampening the system during periods of non-use; to restrict energy loss; to reduce dust intake; and to reduce internal corrosion of the system.

2. Prior Art

Evaporative air conditioning systems are used in residential and commercial applications for cooling the inside of a structure. The system has an external unit that permits air to be drawn into it through vented sides. Moisture is added to the air it is forced through an air-duct to a diffuser located in the ceiling of the structure. The diffuser selectively directs the cooled air throughout the structure. The diffuser and vents are normally formed from sheet metal. The diffuser is normally secured to the end of the air duct by sheet metal screws.

This type of a cooling system is a very economical method of cooling certain structures. However, it creates numerous problems during times of non-use. The biggest problem is that the venting system creates a natural escape path for warm air, during periods when the structure is being heated. Consequently, rising hot air escapes the structure and significantly increases the energy use during heating periods. During these heating periods when the inside of the structure has a positive air pressure the rising hot air is pushed out through the air-ducts to the outside and when a negative air pressure is present inside the structure, cold outside air is sucked into the structure through the air-ducts.

In order to prevent this heat loss, diffusers were constructed with vents that could to selectively open and close. However, the vents can not be constructed so as to be air tight and additionally, the sheet metal skin has no insulative capabilities. Cloth covers were also devised to fit over the outside unit to restrict the heat loss. Those outside covers inherently have the same problems as the opening/closing diffuser, i.e. no insulative capabilities and they can not be sealed so as to be air tight. Neither method alone or in combination are effective to prevent heat loss from a structure during heating periods.

The heat loss problem is exacerbated because of the size of the air ducts. The duct work is typically 17 inches or greater. This size of duct creates a significant path for energy loss.

Additionally, the rising hot air is saturated with moisture. As it rises in the air vents, it condenses. The moisture then causes the vents to rust and corrode. This phenomena only occurs during periods when the structure is being heated, and the heated moist air rises into the vents.

These air cooling systems are also known for their inability to prevent dust from entering the structure. This is especially true during periods of non-use of the air cooling system and when cooler pads are dry.

In order to help eliminate these problems users typically remove the diffuser and stuff insulating material into the vent near the diffuser. The procedure of removal of the diffuser is time consuming and difficult. Often the metal screws holding the diffuser, strip the holes and cause additional problems for reinstallation of the diffuser. The diffuser is also heavy and cumbersome and located in the ceiling of the structure. Its removal and reinstallation is not an easy project. However, the insulative material does help reduce the heat loss, but it is not air tight and the problems of energy loss, dust and corrosion continue to exist.

The only prior art device that is known to applicant is no longer marketed because; it was cost prohibitive, reduced the operating efficiency during cooling; difficult to install; and expensive to stock, display and ship because of its size. This device was attached to the air-duct at ceiling level. The diffuser was hinged at the ceiling to pivot downward. An insulative block was capable of being placed into clips on predisposed inner tabs that protrude into the air-duct to insulate the air duct.

This device was extremely costly to manufacture because of the specially designed and fabricated machine parts, i.e. hinges, latches and tabs. These parts had to be engineered to carry the entire weight of the diffuser, which is significant. The interior tabs on which the insulative member was placed protrude into the air-duct and restrict the airflow through the air-duct and restrict the airflow through the air duct. Typically these tabs reduced the opening size by 1 to 1½ inches in each direction. A reduction, during cooling use, of the air duct by any amount significantly reduces the efficiency of the system.

This device is also difficult to install because of its weight and size. The diffuser was hinged to a frame that could be attached to the ceiling and/or air-duct. The frame and diffuser are of sufficient weight and size that installation is difficult. Also the device could not simply be attached to the duct work with sheet metal screws because of its weight. The frame to which the diffuser is attached has to be capable of carrying the entire weight of the diffuser on the hinged side. This presents a significant problem in installations where no ceiling framing member is located near the air-ducts. This requires the mounting frame be made of heavier metal to accomodatethe additional weight.

The prior art device is also expensive to market because of its size and weight. The diffuser and frame are large and heavy. Shipping of large heavy packages is costly. Likewise, a retailer stocking such a product must have additional space to store and display the device.

The present invention provides a device that permits a diffuser to be quickly and easily removed and replaced or modified by an insulated member that completely seals and insulates the system during periods of non-use. The device permits conversion as frequently as needed, even on a daily basis. It completely eliminates the corrosion cycle by preventing hot air and moisture from entering the sir duct. Its seal is so effective it eliminates the dust problem and its insulative features are as good or better than most ceilings, so that energy loss is eliminated.

SUMMARY OF THE INVENTION

A device for use in an evaporative cooling system that insulates and dampens the system during periods of non-use is described and comprises: an open ended housing member that is secured to the open end of an air-duct, into which a diffuser can be disposed and secured when the system is operating and which can be quickly and easily removed therefrom during non-use and be replaced by an insulating dampening member, which effectively seals the cooling system to prevent heat loss from the structure.

It is an object of the present invention to provide a device which will permit a user to rapidly and efficiently change from an air diffuser to an insulating dampener.

It is another object of the present invention to provide an insulating dampener that effectively seals the air duct from escaping heat from the structure during non-use.

It is still another object of the invention to provide an insulative dampener which will eliminate dust from entering the structure through the air-duct during non-use.

It is still another object of the present invention to prevent moisture and heat from rising into the air-duct and condensing and causing corrosion of the air-duct.

It is still another object of the invention to provide a device which permits optimum air flow through the existing evaporative cooling air-ducts.

DETAILED DESCRIPTION OF THE PREFERRED EMBODIMENTS

This application is co-pending with the inventors application entitled, "One Piece Diffuser and Insulated Dampener for Evaporative Air Cooling System" that was filed simultanelously with this application. The present invention is a device that can be employed in an evaporative cooling system typically used to cool the inside of a structure such as a home or commercial structure. Such systems are normally utilized in climates in which the ambient humidity is very low. In such climates, typically, the summers are hot and the winters are cold. Accordingly, such evaporative systems are only used during the hot, summer months. However, their construction is such that a major air shaft exists from the ceiling, through the roof and other insulating members. That shaft, permits the cold, moistened air to be blown into the structure during the summer, also serves as a direct escape path for all heated air during the periods of non-use. In such a system, a diffuser is normally employed beneath the ceiling height to accommodate air flow and direct it in several directions to thoroughly cool the structure. The present invention is a device which can be employed in a typical evaporative cooling system which will permit the easy exchange of the diffuser with the insulating block which can dampen the entire system during the periods of non-use. The physical components of the present invention will now be described in detail.

It should be noted that while the instant invention is described both in drawings and in preferred description as being a specific form, various changes could be made without violating the spirit or scope of the invention.

Figure 1:
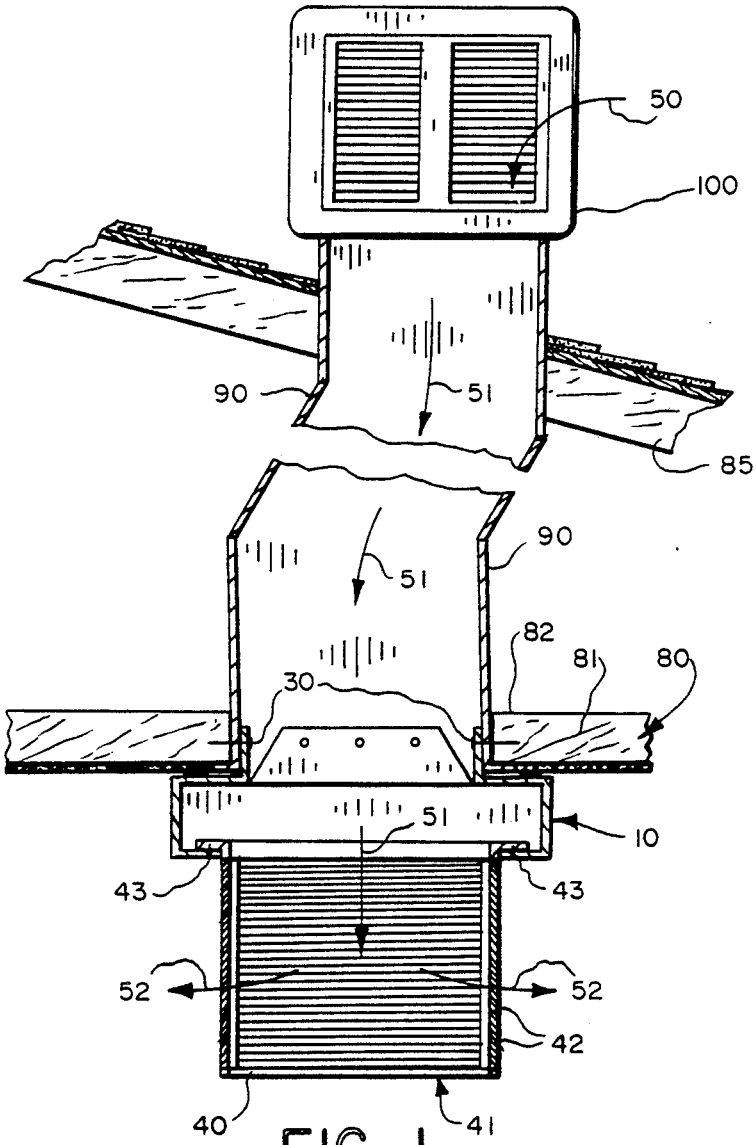
FIG. 1, is a cross-sectional view of the present invention illustrating an evaporative cooling system disposed on the roof of a structure and showing the air-ducts and the present invention holding a diffuser during a period of cooling.

Referring first to FIG. 1, the preferred form of the present invention is illustrated in a cross sectional view. There an evaporative cooler, 100, is shown disposed on the roof, 84, of a structure. An air duct, 90, is shown exiting from the cooler through the roof, 84, and terminating at the underside of the ceiling, 83, of the internal ceiling of the structure. Typically, the components of the system are the cooler, 100, and air ducts, 90, and all formed and fabricated of sheet metal. The duct, 90, is required to be certain sizes for certain coolers. However, for a maximum operating conditions, the larger the duct, 90, the better the cooling characteristic of the system. In FIG. 1, the preferred form of the housing, 10, of the preferred form of the present invention, is shown attached to the bottom end of the air-duct, 90, at ceiling height. Also shown in FIG. 1, is the housing, 10 of the present invention, in which the air diffuser, 40, is shown disposed so that air flow, 50, can pass from the outside, through the cooler, 100, through the air duct, 90, and exit through the diffuser at 52, into the structure.

Figure 3:
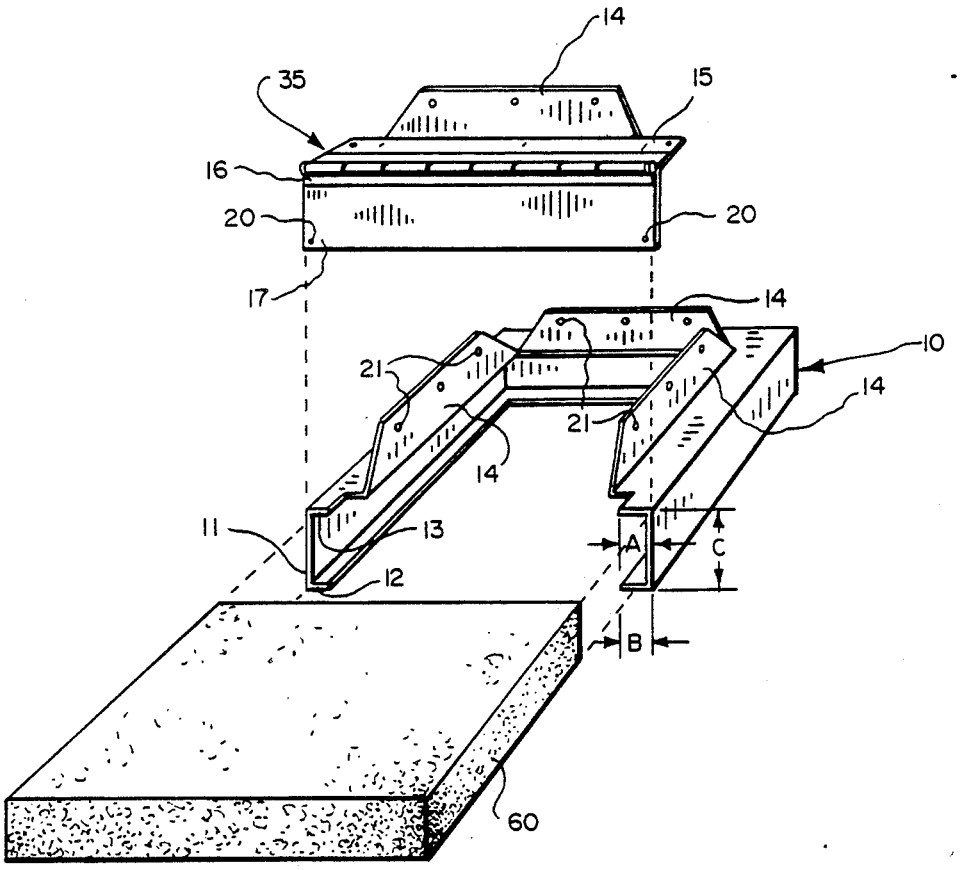
FIG. 3, is an isometric drawing illustrating the present invention with the insulative block partially inserted into the housing.

The housing, 10, of the preferred form of the present invention is illustrated in perspective view in FIG. 3. The frame of housing, 10, is basically a channel member having a upper flange, 13, a vertical flange, 11, and a lower flange, 12. As shown in FIG. 3, upper flange 13 has formed as a part thereof, a vertical extending tab, 14, which has apertures, 21, cut therein, which are used to secure the housing, 10, to the end of the duct, 90. Typically metal screws or other fasteners, 30, are used, as illustrated in FIG. 1. It should be noted that although in the preferred form of the invention, the tab, 14, is shown as extending upward from flange, 13, it could be equally be disposed downward and still perform the same function.

Figure 2:
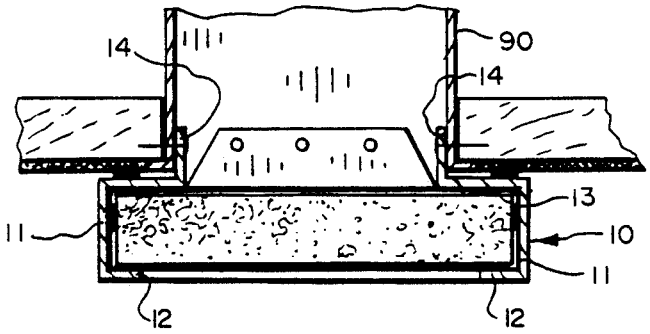
FIG. 2, is a condensed cross-sectional view similar to FIG. 1, except the diffuser has been replaced by the insulating dampener.
Figure 4:
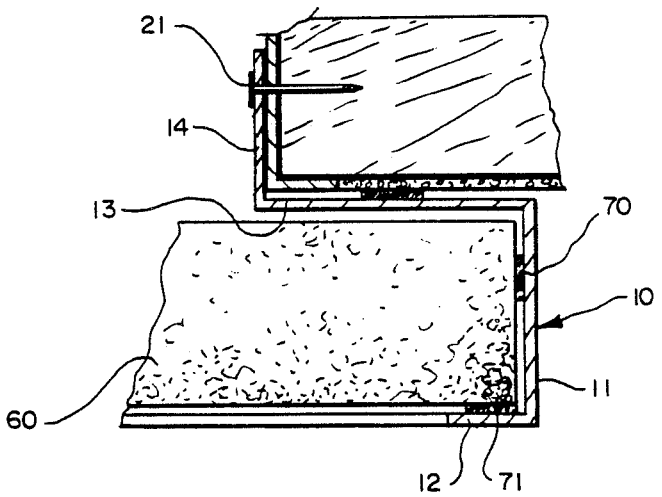
FIG. 4, is a blown up view of a portion of the invention taken along lines 4—4 of FIG. 2.

The size of the air-duct opening defines the size of the upper opening of frame, 10, and fits snugly into duct, 90, so as to not reduce the size of the duct, 90, as shown in FIG. 4. Upper flange, 13, is defined as being "A" wide. This width, "A", will vary depending upon the size of the air-duct of the cooling system. Typically the air-duct is square, but if it is not then the frame member, 10, can be formed to meet the size of the duct. It is extremely important to note that the tabular member, 14, is the only portion of the frame member of the present invention which extends into the air-duct opening. Any reduction by the insertion of the flanges or other material will reduce the size of the opening and make the system less efficient in its operation. Accordingly, upper flange, 13, extends outward from the air-duct, a dimension "A" to vertical member, 11. In the Preferred form, "A" is 2 inches. Vertical member, 11, extends downward a distance "C", and in this embodiment is just greater than 4 inches, however, the depth of flange 11 can vary to accept different sizes of insulating blocks, 60 (FIG. 3). In the preferred form of the present invention, a four inch thick insulative block is used and accordingly, the dimension of C is slightly larger than four inches. The bottom flange, 12, extends back toward the duct opening, a distance "B". This flange forms the bottom edge of housing, 10, and will support either the diffuser as shown in FIG. 1, or the insulating block as shown in FIG. 2. Flange 12 extends a distance B towards the duct opening. It is important to note that the width "B" of flange 12 is always less than width "A" the dimension of the upper flange 13. This is to insure that no obstruction or degradation of the air-duct opening is created, to continue maximum operating conditions of the cooling system.

Housing 10, is a three sided channel member, having one open end, as illustrated in FIG. 3. As shown, either the diffuser or the insulative block can be moved into the housing so as to be enclosed between within the housing 10. In FIG. 3, a insulative block is shown disposed being ready to be disposed into housing. In the dampening stage, the block is disposed completely into frame 10, as shown in FIG. 2.

The three sided housing has disposed on the open end, a hinged member 35, as shown in FIG. 3. This hinged member has an upper plate, 15, and a vertical plate 17, that are secured together by hinge 16. Vertical plate 17 is of the same height as the vertical flange 11 of housing, and plate 15 is of the same width as the upper flange 13, of housing 10. Similarly, a tab 14 is disposed in the inner edge, opposite the hinge of member 15 to accommodate and be secured to the air-duct 90. Thus in installation, member 35 is first installed into the air-duct, such that plate 17 can be rotated on its hinges to be in the same plane as the ceiling or extend vertically downward therefrom. Housing 10 is then inserted into the air-duct opening and secured to the air-duct sides as illustrated in FIG. 1 and 2. When installed, the channel frame housing 10 and hinged member 35 form an enclosed receptacle into which the diffuser 40 or the insulator block 60 can be and secured.

In the preferred form of the present invention, aperture 20 is disposed in the lower portions of the front plate 17, of the hinged member 35. A screw or other securing device can then be used to secure flange 17 to housing 10. In an alternate form of the present invention, a tab can extend from flange 17 towards vertical flange 13 of housing 10 and have a spring loaded locking device, well known in the art, for holding the enclosing plate 17 into place against housing 10.

In FIG. 4, a blown up portion of the invention is shown having the insulative block disposed therein. Insulative tape 71 is attached to the lower flange 12 along its entire perimeter, as shown in FIG. 4. Also an insulative tape, 70, is shown disposed on vertical member 11, along its entire perimeter. When the block is slid into place as illustrated in FIG. 4, a tight seal is formed between the insulative tape and frame 10, thereby securing that no heat or moisture will escape. The rating of the block 60 usually greater than the insulation, 81, provided in the ceiling structure 80. The insulative block, 60, thereby prevents heated air to rise through and into the air-duct through periods of non-use. It also prevents heated and moist air from entering into air duct 90 and condensing and corroding the air-duct. In such an application, the disposition of the insulative member, at the interior ceiling height permits the air-duct to take on the temperature of the ambient conditions. This further prevents the condensation of any moisture contained therein and increases the length of life of the air-duct. The insulative block 60 also serves to act as a dust barrier from any air which may enter the air conditioner 100 or air-duct, 90 and thereby prevents it from coming into the house. The sealing features disclosed herein also prevent heat from escaping during periods of negative or positive pressure.

Perhaps, however, the most important feature of the preferred embodiment of the invention, is the capability of quickly and easily removing the diffuser 40, and replacing it with the insulative block, 60, or by replacing the insulative block with the diffuser 40. In hot summer temperatures, where the air conditioning is operating most of the time it is not important to exchange the diffuser and insulating block. However, during the spring or fall, various daytime temperatures can be sufficient to warrant use of the air conditioner while night-time temperatures may still warrant the use of a heater in the structure. The ability to exchange the block and the diffuser rapidly and quickly make it so convenient that a owner could exchange the diffuser and block as needed. This is an important consideration to encourage energy conservation.

In all art forms presently known, the exchange of diffuser and an insulative dampener is so difficult that if done, is only done on an annual or semi-annual basis. Because of this difficulty, a significant amount of energy is used or lost from the structure during periods of non-use of the air conditioning system, during heating of the structure. The present invention then encourages rather than discourages the conservation of energy.

In another embodiment of the invention housing 10 can be made of sufficient depth so as to permit both the diffuser and insulating block to be disposed therein at the same time. In such a case, the diffuser can be permantly maintained in the housing and the insulating block can simply be removed during periods of non-use of the cooling system.

The present invention is designed so as to be adapted and used in existing or new installations and to provide the same characteristics disclosed herein.

While the present invention has been described herein, it will be understood by those skilled in the art that various changes of form and detail may be made therein without departing from the spirit or scope of the invention.

I claim:

1. A device for use in an evaporative cooling system for a building structure having a ventilation duct opening into said structure that permits rapid selective modification between; a diffuser means, for permitting the free inward flow of cool air into said structure during use, and an insulated dampening means, for preventing heat loss through said ventilation duct during non-use comprising: a frame means, an insulated dampening means, and a diffusing means where said frame means extends beneath the ceiling of said structures and has at least one open end and is channel shaped having an upper flange slightly larger than a lower flange, said lower flange for alternately supporting said diffuser means or said insulated dampening means, said frame means having a hinged flange capable of closing said at least one open side to secure said insulated dampening means or diffusing means within said frame means.

2. The device of claim 1 wherein an insulated tape means is disposed on said lower flange of said frame means, to seal said frame means and said insulative dampening means.

3. The device of claim 1 wherein said insulated dampening means has an outward facing decorative surface.

4. The device of claim 1 wherein said diffuser means and said insulative dampening means can be selectively and simultaneously disposed in said frame means during periods of non-use of said cooling system.

5. The device of claim 1 wherein said lower flange of said frame means has a larger perimeter than the ventilation duct opening so as not to impede air flow through said diffuser during periods of use of said cooling system.

* * * * *